US006619402B1

(12) United States Patent
Amory et al.

(10) Patent No.: US 6,619,402 B1
(45) Date of Patent: Sep. 16, 2003

(54) SYSTEM FOR ENHANCING FLUID FLOW IN A WELL

(75) Inventors: Marc Emmanuel Amory, Rijswijk (NL); Roelof Daling, Rijswijk (NL); Carlos Alberto Glandt, Rijswijk (NL); Robert Nicholas Worrall, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/088,151

(22) PCT Filed: Sep. 15, 2000

(86) PCT No.: PCT/EP00/09184

§ 371 (c)(1),
(2), (4) Date: Mar. 13, 2002

(87) PCT Pub. No.: WO01/20126

PCT Pub. Date: Mar. 22, 2001

(30) Foreign Application Priority Data

Sep. 15, 1999 (EP) ..... 99203017

(51) Int. Cl.[7] ..... E21B 43/16; E21B 43/13

(52) U.S. Cl. ..... 166/370; 166/50; 166/117.5; 166/105; 166/313

(58) Field of Search ..... 166/313, 370, 166/117.5, 117.6, 50, 66.4, 68, 68.5, 105

(56) References Cited

U.S. PATENT DOCUMENTS

| | | | | |
|---|---|---|---|---|
| 2,242,166 A | * | 5/1941 | Bennett | 166/105 |
| 3,016,844 A | | 1/1962 | Vincent | |
| 3,022,829 A | | 2/1962 | Hodges | |
| 3,054,456 A | | 9/1962 | Hammaker | |
| 3,223,109 A | | 12/1965 | Cummings | |
| 3,357,492 A | * | 12/1967 | Hubby | 166/106 |
| 3,386,391 A | | 6/1968 | Garrett | |
| 3,474,859 A | | 10/1969 | Chenoweth | |
| 3,741,298 A | | 6/1973 | Canton | |
| 4,189,003 A | | 2/1980 | James et al. | |
| 4,413,958 A | | 11/1983 | Webb | |
| 4,432,416 A | | 2/1984 | Welch et al. | |
| 5,207,096 A | | 5/1993 | Castel et al. | |
| 5,404,943 A | | 4/1995 | Strawn | |
| 5,447,201 A | | 9/1995 | Mohn | |
| 5,839,508 A | * | 11/1998 | Tubel et al. | 166/65.1 |
| 5,881,814 A | * | 3/1999 | Mills | 166/313 |
| 6,119,780 A | * | 9/2000 | Christmas | 166/313 |

FOREIGN PATENT DOCUMENTS

| | | |
|---|---|---|
| EP | 0 922 835 | 6/1999 |
| WO | 97 41330 | 11/1997 |

* cited by examiner

*Primary Examiner*—Hoang Dang

(57) ABSTRACT

A system for enhancing fluid flow into and through a hydrocarbon fluid production well comprising a series of flow boosters, such as electrically or hydraulically driven moineau-type pumps or centrifugal pumps or turbines, for controlling and/or boosting fluid flow from various regions of a drainhole section of the well into a production tubing within the well.

9 Claims, 2 Drawing Sheets

SYSTEM FOR ENHANCING FLUID FLOW IN A WELL

BACKGROUND OF THE INVENTION

Figure 1:
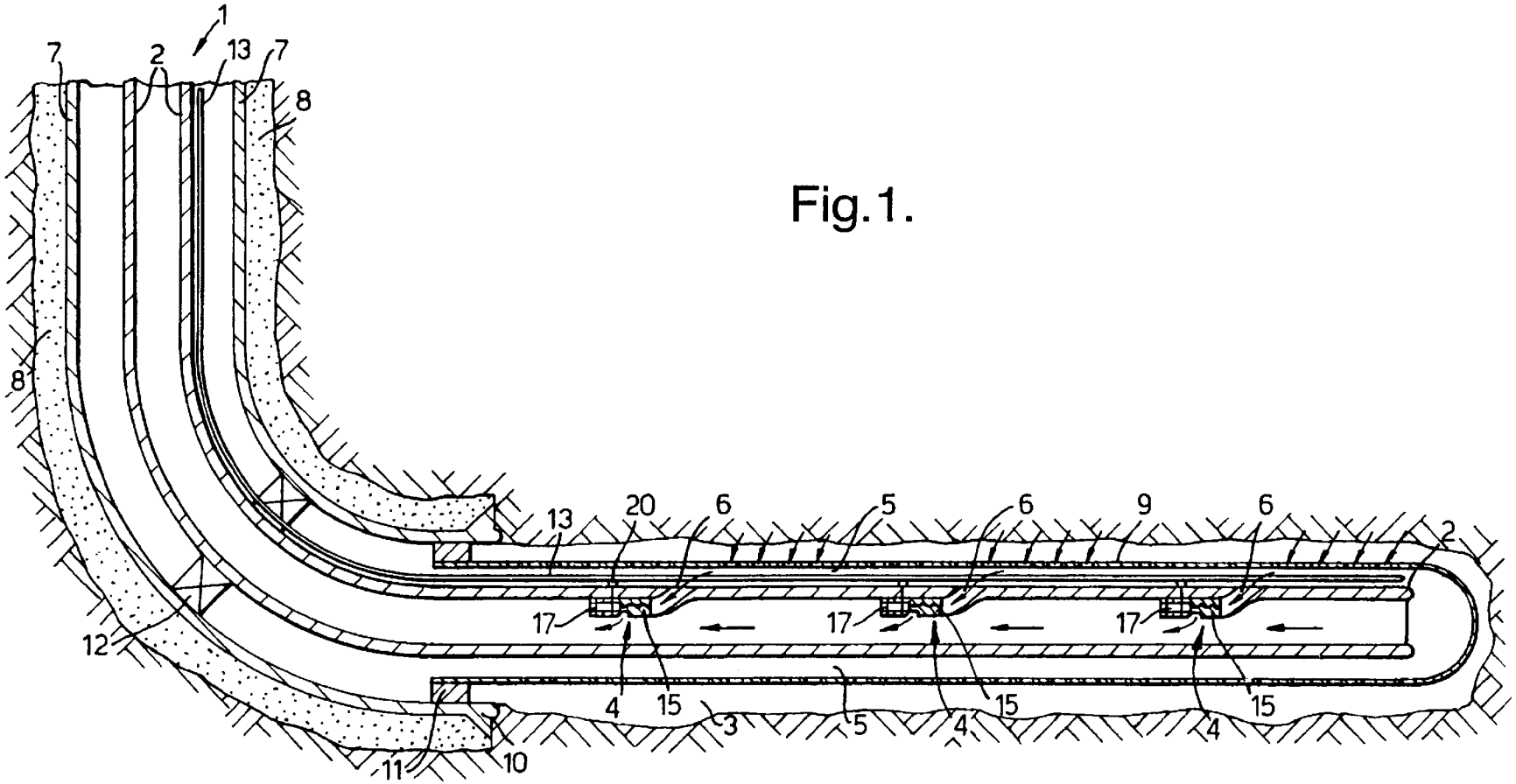

The invention relates to a system for enhancing fluid flow into and through a hydrocarbon fluid production well.

Such a system is known from European patent specification 0558534 and U.S. Pat. No. 5,447,201. The system known from these prior art references comprises a series of flow control devices, in the form of adjustable valves, for controlling fluid flow from various regions of a drainhole or reservoir inflow section of the well into a production tubing within the well.

In the known system each valve throttles back production from a specific region of the drainhole section which will reduce the flux of fluids from the reservoir into that region. To compensate for the restriction of fluid flow into the well the known system is equipped with a flow booster which is installed in the production tubing downstream of the drainhole section of the well.

Disadvantages of the known system are that the downhole valves may get stuck as a result of corrosion, sand influx or deposition of salts, scale and that the combination of a series of valves and a flow booster in the well creates a large amount of wear prone components in the well and requires a complex assembly of electrical wiring to operate and control these components. Furthermore the valves can only be replaced after the flow booster in the production tubing has been removed so that replacement of valves requires a complex and costly workover operation wherein the flow booster and production tubing need to be removed to gain access to the valves.

The system according to the preamble of claim 1 is known from European patent EP 0922835, which discloses a multilateral well in which pumps are installed at the branch-points to control the influx of the various branches into the main wellbore. The known pumps block the entrances of the branches such that maintenance or logging tools cannot be inserted into the branches and the entire production string and associated pump assemblies has to be removed from the well if maintenance or logging activities are required in one of the well branches.

U.S. Pat. No. 5,881,814 discloses another non-bypassable multistage pump assembly in a well. U.S. Pat. Nos. 3,741,298 and 5,404,943 disclose multiple pump assemblies in which the lowermost pump cannot be bypassed by logging or maintenance tools whereas the upper pump units are arranged adjacent to a by-pass conduit and are secured to the production tubing such that the entire tubing string has to be removed if the pumps need to be repaired or replaced.

The invention aims to overcome these disadvantages and to provide a flow booster systems which does not obstruct entrance to the lowermost parts of the well and where the flow boosters can be removed or replaced individually without removing the production tubing or liner.

SUMMARY OF THE INVENTION

The system according to the invention comprises a series of flow boosters comprising pump and motor assemblies which control the inflow rate of fluid from various regions of a drainhole section of a well into a production tubing or liner within the well and which flow boosters are retrievably mounted in side pockets of said production tubing or liner.

Suitably the flow boosters comprise a series of electrically or hydraulically driven moineau-type positive displacement pumps or rotary turbines which are mounted inside tubular mandrels that are retrievably mounted inside side pockets in a production liner or tubing.

Preferably each pump is equipped with sensors for measuring the flow rate and/or composition of fluids passing through the pump and the pump rate is adjustable automatically or manually in response to any significant deviation of the fluid rate and/or composition from a desired flow rate and/or composition.

It is also preferred that the production tubing extends through the drainhole section and is surrounded by an annular inflow zone and the downhole pumps are distributed along the length of said inflow zone such that each flow booster draws fluid from the inflow zone and discharges fluid into the production tubing. Suitably one or more annular insulation packets are arranged in said annular inflow zone to create an annular inflow zone in which a plurality of hydraulically insulated drainhole regions are present and a plurality of flow boosters draw fluid from a plurality of said regions. Suitable annular insulation packers are inflatable rubber packers or annular bodies of cement which are injected into the annulus at locations halfway between a pair of adjacent pumps.

It is observed that it is known from U.S. Pat. No. 3,223,109 to insert passive gas-lift valves in side pockets of a production tubing above the casing packer and above the well inflow region. The known gas-lift valves do not have an electric or hydraulic power supply and do not adjust the fluid influx into various regions of the well inflow region.

DESCRIPTION OF PREFERRED EMBODIMENT

Figure 2:
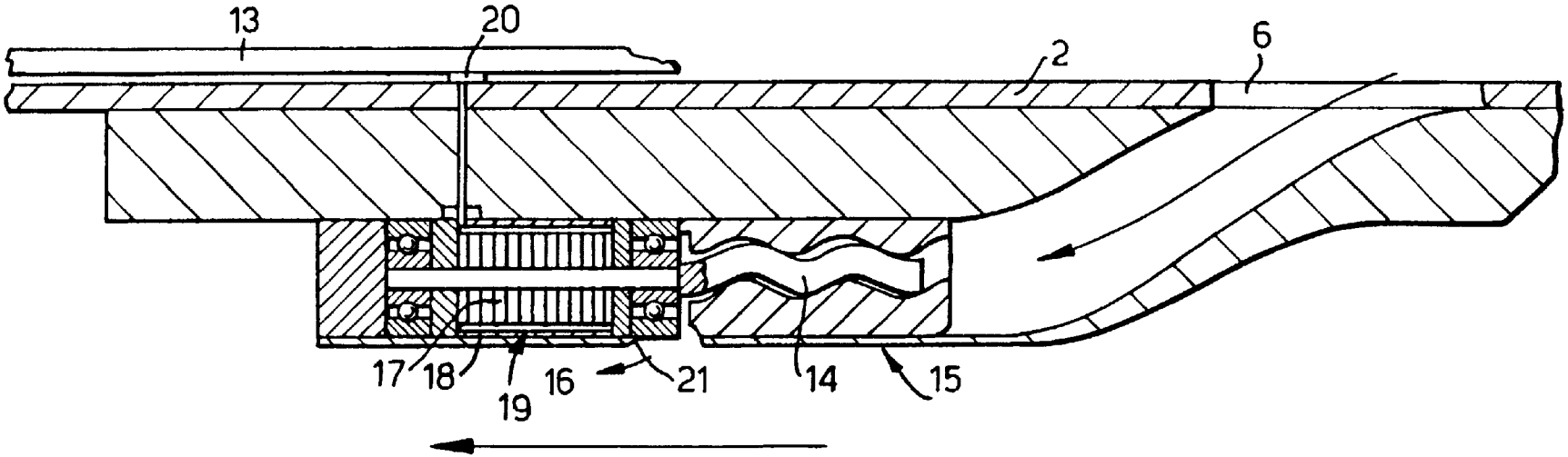

A preferred embodiment of the system according to the present invention will be described by way of example with reference to the accompanying drawings, in which FIG. 1 shows a schematic longitudinal sectional view of a hydrocarbon production well which is equipped with a system according to the present invention; and FIG. 2 shows at an enlarged scale one of the flow boosters of the system shown in FIG. 1.

Referring now to FIG. 1 there is shown an oil production well 1 of which the production tubing 2 extends through a substantially horizontal drainhole section 3 and is equipped with three flow boosters 4 which pump fluid from various regions of an annular inflow region 5 through three longitudinally spaced orifices 6 in the wall of the production tubing 2.

The well 1 further comprises a well casing 7 which is cemented in place by an annular body of cement 8. A slotted production liner 9 is secured to the lower end of the casing, near the casing shoe 10 by means of a liner hanger 11.

The production tubing is retrievably mounted within the casing 7 and liner 9 by means of a series of packers 12.

An electrical, fibre optical and/or hydraulic power and signal transmission conduit 13 is strapped to the outer surface of the production tubing 2.

As shown in more detail in FIG. 2 each flow booster is an electrically driven moineau-type or centrifugal-type pump and the rotor 14 of each pump 15 is directly secured to the output shaft 16 of an asynchronous electrical motor 17 of which the rotor part comprises one or more permanent magnets and the stator part 18 comprises coiled electrical conduits 19 which generate in use a rotating electromagnetic field.

The coiled electrical conduits 19 are connected to the electrical power and signal transmission conduit 13 via one or more wet mateable induction electrical connectors 20.

Each pump 15 and motor 17 is mounted within a tubular mandrel 21 which is retrievably mounted within a side pocket 22 in the production tubing 2.

Each mandrel 21 is equipped with sensors (not shown) for measuring the flow rate and composition of fluids passing through the orifice 6 and pump 15 and the sensors are connected to a control unit which adjusts the rate of rotation of the motor in response to variations of the flow rate or composition from a desired reference flow rate and/or composition.

In many situations due to pressure drops in an elongate horizontal drainhole section influx of fluids tends to be larger at the heel than at the toe of that region.

In such case it is preferred that the pumprate of the flow booster 4 at the toe of the well 1 is larger than the pumprate of the flow booster 4 in the middle and that the pumprate of the flow booster 4 in the middle of the well is larger than the pumprate of the flow booster 4 at the heel of the well 1. Thus the series of flow boosters 4 counteract pressure drops in the drainhole section and thereby achieve more uniform draw-down over the whole length of the drainhole section, thereby increasing production from a given reservoir.

Each flow booster 4 is equipped with an e.g. flapper type, non-return valve (not shown) which prevents fluids to flow back from the production tubing 2 into the surrounding annulus 5 in case the pump would fail.

Each tubular mandrel 21 may have a kidney or oval shape to permit the use of a larger pump and motor and sensor and control unit within the mandrel 21.

The motor output torque and speed and pressure drop across each pump 15 may be measured as for an axial pump this is related to the density of the oil/gas/water fluid mixture and to the fluid viscosity.

The viscosity and density of the gas/oil/water mixture or emulsion can also be measured by carrying out surface tests at downhole pressure and temperature, the fluid sample having been mixed to simulate downhole conditions. Thus the fluid mixture being pumped by each pump 15 may be inferred from downhole data. The motor output torque may be calculated from its downhole back electromagnetic field (magnitude and phase) corrected for winding temperature.

If the well 1 is an oil well and the influx of gas is not desired the pumps 15 may be designed to stall or become less efficient an ingress of gas.

The speed of revolution of the electric motors 17 may be varied to optimise the total flow of oil from the entire drainhole section 3. The pumps 13 may be turned to allow a selected amount of gas to be pumped into the production tubing 2 to create a gas lift in the vertical upper part of the production tubing 2.

The intelligence and control system may be downhole or at surface or distributed.

The electrical conduit 13 can be a single conduit or a bundle of conduits or contain a releasable connections downhole in a hanger 11 and instrumentation connector.

If one or more pumps 15 are driven by hydraulic motors or are formed by jet pumps then the motor or pump may be powered by injection of treating chemicals such as an emulsifier, $H_2S$ scavenger, corrosion inhibitor, descaler, Shellswim (a Shell trade mark) or a mixture of these fluids into the pump 15 or motor. Hydraulic conduits extending between the wellhead and the downhole pump and motor assemblies may also be used to inject lubricating oil into the pump and motor bearing assemblies.

The pumprates of the pumps 15 may be cyclically varied such that the point of maximum draw-down of oil into the production tubing 2 is continuously moved up and down between the lower and upper end of the inflow region. Such cyclic variation of the influx into the well reduces the risk of water or gas coning during production.

What is claimed is:

1. A system for enhancing fluid flow into and through a hydrocarbon fluid production well, the system comprising a series of flow boosters which comprise pump and motor assemblies for controlling fluid flow from various regions of a drainhole or reservoir inflow section of a well into a production tubing within the well, characterized in that the flow boosters are retrievably mounted in side pockets of the production tubing.

2. The system of claim 1, wherein the production tubing extends through a substantially horizontal drainhole section and is surrounded by an annular inflow zone and the flow boosters are distributed along the length of said inflow zone such that each flow booster draws fluid from the annular inflow zone and discharges fluid into the production tubing.

3. The system of claim 2, wherein one or more annular insulation packers are arranged in said annular inflow zone to create an annular inflow zone in which a plurality of hydraulically insulated drainhole regions are present and a plurality of flow boosters draw fluid from a plurality of said regions.

4. The system of claim 1, wherein the flow boosters are positive displacement pumps or rotary turbines that are driven by electrical or hydraulic motors.

5. The system of claim 4, wherein the flow boosters are moineau-type positive displacement pumps of which a rotor is directly coupled to an output shaft of an asynchronous electrical motor having a rotor part comprising one or more permanent magnets.

6. The system of claim 5, wherein the flow booster and motor are located within a tubular mandrel which is retrievably mounted in a side pocket of the production tubing and the motor is connected to an electrical conductor passing along a liner or said production tubing via one or more wet mateable electrical connector.

7. The system of claim 6 wherein pressure, temperature and/or fluid composition measurement sensors are mounted inside each mandrel and are connected to a flowrate control system of each flow booster such that the pumprate of a flow booster is restricted in case the measured flowrate is significantly larger than that of one or more other flow boosters or if the produced fluids comprise a significant amount of water or sand or another undesired fluid, such as natural gas if the well is an oil well.

8. A method of operating the system of claim 1, wherein the flow boosters are in use controlled such that pumprate of each booster are in use controlled such that pumprate of each booster cyclically varies between a maximum and minimum value and the pumprate variations of the various flow boosters are out of phase relative to each other.

9. The method of claim 8, wherein the pumprates of the various flow boosters are cyclically varied such that the point of maximum influx into the inflow section of the well is cyclically moved between a lower end and an upper end of said inflow section.

* * * * *